US011076724B1

(12) United States Patent
Vaughn

(10) Patent No.: US 11,076,724 B1
(45) Date of Patent: Aug. 3, 2021

(54) DEVICES AND METHODS FOR WATER CONTROL

(71) Applicant: Marsha B. Vaughn, Hephzibah, GA (US)

(72) Inventor: Marsha B. Vaughn, Hephzibah, GA (US)

( * ) Notice: Subject to any disclaimer, the term of this patent is extended or adjusted under 35 U.S.C. 154(b) by 0 days.

(21) Appl. No.: 16/899,900

(22) Filed: Jun. 12, 2020

Related U.S. Application Data

(63) Continuation of application No. 16/000,163, filed on Jun. 5, 2018, now Pat. No. 10,709,297.

(60) Provisional application No. 62/515,170, filed on Jun. 5, 2017.

(51) Int. Cl.
*A47K 3/12* (2006.01)
*A61G 7/10* (2006.01)

(52) U.S. Cl.
CPC ..... *A47K 3/122* (2013.01); *A61G 7/1003* (2013.01)

(58) Field of Classification Search
CPC ..... A47K 3/122; A61G 71/003
USPC ..... 4/560.1, 580
See application file for complete search history.

(56) References Cited

U.S. PATENT DOCUMENTS

| | | | | | |
|---|---|---|---|---|---|
| 1,408,812 | A * | 3/1922 | Leighton | E03C 1/181 | 4/658 |
| 1,627,721 | A * | 5/1927 | Wolff | A47L 19/02 | 4/656 |
| 1,628,746 | A * | 5/1927 | Russel | A47L 19/02 | 134/92 |
| 1,709,545 | A * | 4/1929 | Sheppard | E03C 1/181 | 4/658 |
| 4,878,257 | A * | 11/1989 | Hardin | E03C 1/181 | 4/658 |
| 5,361,428 | A * | 11/1994 | Nanowsky | A47K 3/122 | 4/558 |
| 5,381,564 | A * | 1/1995 | Carroll | A47K 3/001 | 4/559 |
| 7,269,861 | B1 * | 9/2007 | Miller | A47K 3/302 | 4/609 |
| 9,260,845 | B1 * | 2/2016 | Siegel | E03C 1/181 | |
| 10,709,297 | B1 * | 7/2020 | Vaughn | A47K 3/001 | |

* cited by examiner

*Primary Examiner* — Huyen D Le
(74) *Attorney, Agent, or Firm* — Morris, Manning & Martin, LLP; Daniel E. Sineway, Esq.

(57) ABSTRACT

Disclosed are methods, devices and kits for controlling water flow when using a transfer bench, comprising a transfer bench splash guard.

15 Claims, 3 Drawing Sheets

DEVICES AND METHODS FOR WATER CONTROL

CROSS REFERENCE TO RELATED APPLICATIONS

This application is a continuation of and claims benefit and priority to, co-pending U.S. patent application Ser. No. 16/000,163, filed on Jun. 5, 2018, entitled "DEVICE AND METHODS FOR WATER CONTROL," which claims priority to U.S. Provisional patent Application No. 62/515,170, filed Jun. 5, 2017, and entitled "DEVICES AND METHODS FOR WATER CONTROL," each of which are incorporated herein by reference in their entirety.

TECHNICAL FIELD

Disclosed herein are methods and devices for preventing fluid exiting a receptacle when using a transfer bench.

BACKGROUND

Bathing while using a transfer bench creates issues for the bather and any attendants. When the transfer bench is positioned in or on the bathing enclosure, the bench does not allow the shower curtain to be appropriately closed. Furthermore, water that contacts the transfer bench can escape the bathing enclosure through openings in the seat of the transfer bench when a portion of the transfer bench is outside the receptacle.

Therefore, there is a long-felt but unresolved need for a device and methods for water control that are easily used by the user of a transfer bench or by caregivers.

BRIEF SUMMARY OF THE DISCLOSURE

Briefly described, and according to exemplary embodiments, aspects of the current disclosure generally relate to devices and methods used to control water when a subject is using a transfer bench, such as while bathing. More specifically, devices and methods relate to preventing water from exiting a receptacle, such as the bathing container, a bathtub or shower area, and onto the floor while using a transfer bench.

These and other aspects, features, and benefits of the present devices and methods will become apparent from the following detailed description, taken in conjunction with the following drawings. Additionally, variations and modifications thereto may be effected without departing from the spirit and scope of the novel concepts of the disclosure.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein:

FIG. 7 is a picture of a topside view of an exemplary transfer bench showing the seating area having multiple openings, which allow fluids to pass through.

DETAILED DESCRIPTION

Figure 1:
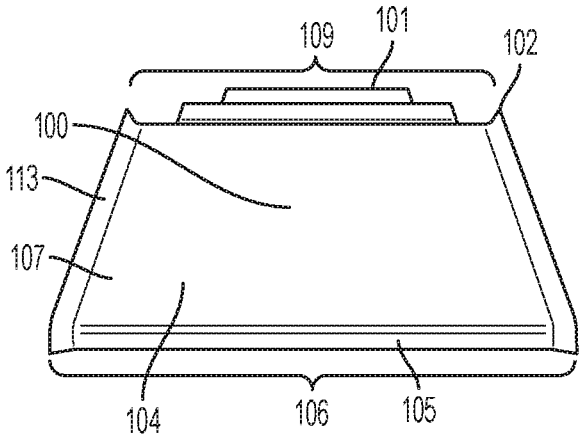
FIG. 1 is picture of a topside view of an exemplary transfer bench splash guard.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Overview

Aspects of the present disclosure generally relate to devices and methods used to control water when a subject is using a transfer bench, such as while bathing. In various embodiments, the transfer bench includes multiple openings on the top surface to allow the passing of fluids into a receptacle, such as a bathing enclosure. In particular embodiments, the transfer bench includes a splash guard attached to the transfer bench to aid in the controlling the flow of water to the receptacle. The splash guard comprises of an open side for fluid to flow out of the transfer bench splash guard.

The transfer bench may be made of any suitable material, including but not limited to plastic, wood, or steel, and may be rigid, semi-rigid or flexible. A transfer bench splash guard may be water-proof or water resistant, or may have a removable water-resistant covering placed on top of top surface, such that at least a portion of top surface is covered by covering.

As will be understood, the transfer bench may replace conventional bath benches or chairs for virtually any type of shower or bathtub.

The above components (and others), will be discussed below in relation to the figures.

Exemplary Embodiments

Referring now to the figures, for the purposes of example and explanation of the fundamental processes and components of the disclosed systems and methods, reference is made to FIG. 1, which illustrates an exemplary, high-level overview of one embodiment of the methods and devices for aiding in controlling water applied to a subject that is placed upon a transfer bench having openings in its top surface through which fluid can flow. As used herein, a subject can be any solid object, such as a human, regardless of age or ability, an animal or an inanimate structure. For example, the subject can be a human or a flower pot with flowers. As will be understood and appreciated, the exemplary, high-level overview shown in FIG. 1 represents merely one approach or embodiment of the present system, and other aspects are used according to various embodiments of the present system.

Figure 5:
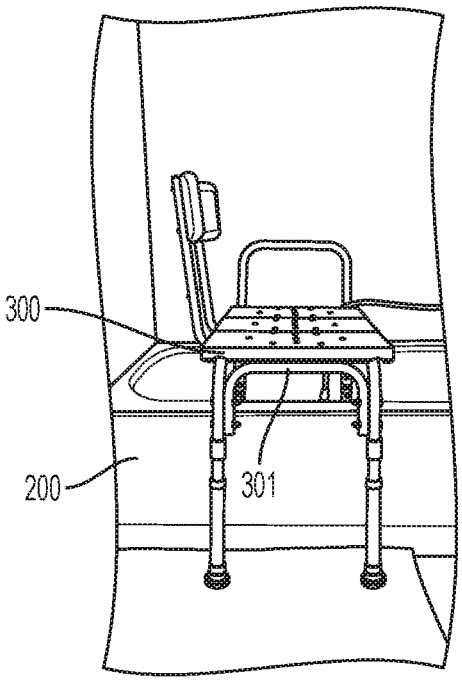
FIG. 5 is a picture of an exemplary transfer bench positioned in a bathing enclosure, in this case, a bath tub.
Figure 6:
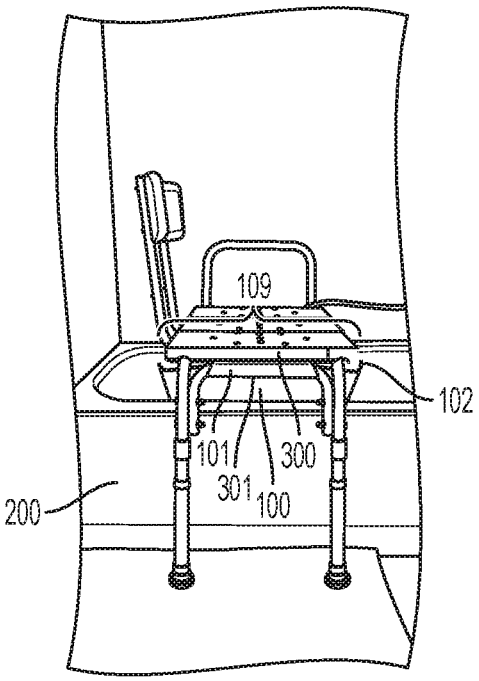
FIG. 6 is a picture of an exemplary transfer bench splash guard attached to the transfer bench of FIG. 5.

For convenience, reference is made herein to a subject, such as human, regardless of age or ability, positioned upon the transfer bench. Such a subject may be bathing. As used herein bathing means that water or another fluid is being applied to the subject positioned on the transfer bench. When the fluid is applied to the subject, excess fluid flows through the openings in the transfer bench and fluid can flow around and under the transfer bench. Devices and methods disclosed herein channel the excess fluid, such as that flowing through the openings in the transfer bench, into a receptacle, such as a bathing enclosure. As shown in FIGS. 5 and 6, a bathing enclosure can be a bath tub. As used herein, a receptacle can be a bathing enclosure, a bath tub, a shower enclosure, an area for bathing that contains a drain, a bag, a bucket or an appropriately shaped container for fluids. As can be understood, the devices and methods disclosed herein can be adapted and shaped accordingly to transfer fluids flowing through openings in a transfer bench, or off other surfaces of a transfer bench, to a receptacle. For ease of discussion, fluid flowing through openings in the transfer bench as discussed, though it is contemplated that fluid can flow off the transfer bench and be contained and directed by devices disclosure herein.

In an aspect, a transfer bench has openings in the top surface that allow water to flow through. See FIG. 7, openings 350. As shown in FIGS. 5 and 6, when used in a bath tub, a transfer bench is not fully contained within the bath tub. Water flowing through the openings in a portion of the transfer bench that are outside the rim of the tub fall onto the floor outside the tub. For example, methods and devices disclosed herein control and direct the flow of the fluid passing through the openings of the transfer bench so that the fluid does not exit the bath tub.

Figure 2:
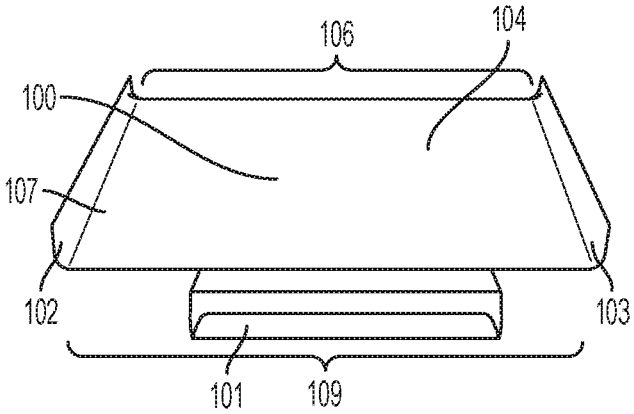
FIG. 2 is a picture of a topside view of an exemplary transfer bench splash guard, taken from a position 180 degrees from FIG. 1.
Figure 3:
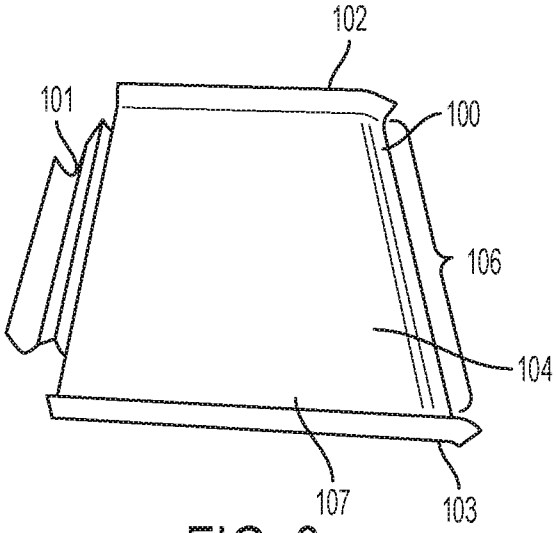
FIG. 3 is a picture of a topside view of an exemplary transfer bench splash guard, taken from a position 90 degrees from FIG. 1.

Referring now to FIGS. 1, 2 and 3, exemplary transfer bench splash guard 100 comprises a semi-planar, generally rectangularly-shaped, structure 105 having at least one side; attaching element 101 is located on attachment side 109; open side 106 is the side opposite from attaching side 109; two other sides, 102 and 103 are perpendicular to sides 106 and 109, are opposite from each other, and have ends that are curved upward. The upwardly curved ends of sides 102 and 103 are useful for containing and directly fluid contacting top surface 107 to a receptacle (not shown in FIGS. 1, 2 and 3) in an aspect, the upwardly curved ends of sides 102 and 103 are of a sufficient height to prevent the majority of fluid from flowing off the sides 102 and 103 and instead, channel the fluid toward open end 106. The end(s) of sides 102 and/or 103 may be shaped so that an end may mate with a portion of a transfer bench. For example, both sides 102 and 103 may be shaped so that the snap-fit with the appropriate edges of the set of a transfer bench, which would be useful for storage and transport of a combined transfer bench and a transfer bench splash guard. For example, only one side, either side 102 or side 103 may be so shaped. In an aspect, one or both of sides 102 or 103 may have an attachment element for "latching" or attaching one or both sides of a transfer bench splash guard to the seat of a transfer bench. A transfer bench splash guard structure 105 may further contain a handle (not shown) for carrying a transfer bench splash guard, and such a handle may be an extension of any of the sides of a transfer bench splash guard.

As shown in FIGS. 1, 2 and 3, transfer bench splash guard structure 105 has four sides. However transfer bench splash guard structure 105 may include additional sides, depending on the shape of transfer bench splash guard structure 105. In an aspect, transfer bench splash guard structure 105 has at least one side, attachment side 109 comprising attaching element 101.

In an aspect, a transfer bench splash guard may not be a semi-planar generally rectangularly-shaped structure, but may be shaped in a manner so that fluid flowing through openings in a transfer bench falls onto the top surface of the transfer bench splash guard, and top surface 107 may be shaped to direct the fluid to a receptacle. For example, the transfer bench splash guard may be shaped as a square, a triangle, a circle, a cone, etc. Top surface 107 may be uniformly flat or may have grooves or raised areas for directing the flow of the fluid. Transfer bench splash guard structure 105 may be substantially planar or may be curved in a direction to encourage fluid flow. Transfer bench splash guard structure 105 can be dimensioned to have a width or length equivalent to a transfer bench, greater than a transfer bench, or smaller than the transfer bench, so that at least a portion of the fluid flowing through openings in the seat portion of a transfer bench lands on contacts transfer bench splash guard structure 105, so that transfer bench splash guard structure 105 contains and directs the flow of the contacted fluid.

A transfer bench splash guard may be made of any suitable material, including but not limited to plastic, wood, or steel, and may be rigid, semi-rigid or flexible. A transfer bench splash guard may be water-proof or water resistant, or may have a water-resistant covering 104 placed on top of top surface 107, such that at least a portion of top surface 107 is covered by covering 104. Covering 104 may or may not be removable. Covering 104 may be replaced when worn out or soiled and may be replaced with a new or clean covering 104. Covering 104 may cover all or a portion of transfer bench splash guard structure 105.

As shown in FIGS. 1, 2 and 3, transfer bench splash guard structure 105 has open side 106. Open side 106 is shaped for fluid to flow out of transfer bench splash guard 100. Open side 106 may be planar and continuous with top side 107 so fluid flows off all or a portion of open side 106, or open side 106 may be grooved, or have openings for fluid to flow through. In an aspect, open side 106 has a contacting element for maintaining contact with the receptacle. A contacting element may be shaped to conform to and attach to a receptacle or may be material that aids in contact with a receptacle, such as a rubberized covering to prevent open end 106 from slipping in its contact with a receptacle. It is intended that fluid drains from open side 106. Open side 106 can be substantially flat or curved to encourage fluid flow Open side 106 may include directed funnels to aim the fluid drainage in a particular direction. Open side 106 may further comprise a connection to a drainage system, such as a pipe, that leads to a drainage area. Open side 106 may comprise a grated area that allows fluid to pass through, but not larger or hard materials, as those are collected rather than drained into the receptacle.

Figure 4:
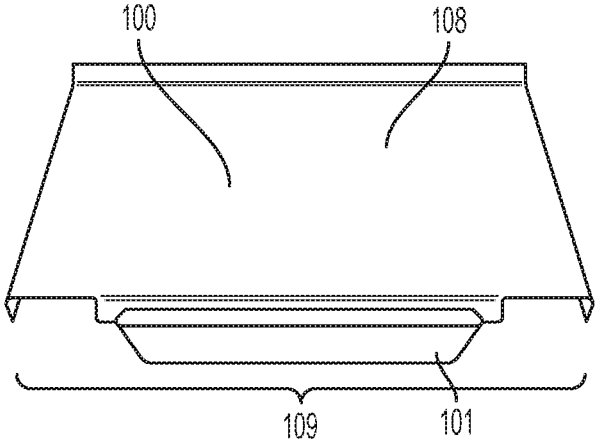
FIG. 4 is a picture showing the bottom view of an exemplary transfer bench splash guard.

In FIG. 4, the bottom side 108 may be made of the same or different material from the rest of transfer bench splash guard structure 105, and may or may not be covered by covering 104. Also shown in FIG. 4, are attachment side 109 comprising attaching element 101.

As is shown in FIGS. 1, 2, 3 and 4, attachment side 109 comprises attaching element 101 for attaching the transfer bench splash guard 100 to a transfer bench. As shown in FIGS. 1, 2, 3 and 4, attaching element 101 is shaped to connect onto a portion of the seat of a transfer bench via a suitable fastener (e.g., snaps, bolts, screws, rivets, pins, etc.). For example, shown in FIGS. 5 and 6, horizontal rail 301 of transfer bench 300 is a rounded tubular structure. Attaching element 101 is shaped to receive a rounded tubular structure so that when attaching element 101 partially surrounds horizontal rail 301, as shown in FIG. 6, transfer bench splash guard structure 101 is attached to horizontal rail 301 of transfer bench 300. For example, in FIGS. 1, 2, 3 and 4, attaching element 101 forms the end structure of attachment side 109 and is formed as a curved end that will partially cover, and snap on and off, a rounded tube. Alternatively, attaching element 101 may attach transfer bench splash guard structure 105 tightly so that essentially the connection of the two is permanent. In various embodiments, the attaching element 101 to the transfer bench splash guard structure 105 is not intended for quick attachment and removal.

Attaching element 101 can be a hook or clasp of sufficient dimension to connect with a transfer bench such that transfer bench splash guard structure 105 is maintained in a position underneath at least a portion of the openings in the seat of the transfer bench. As shown in FIGS. 1, 2, 3, 5 and 6, attaching element 101 may be attached to transfer bench 300 via a substantially horizontal rail 301 on transfer bench 300. Attaching element 101 is attached to the transfer bench 300 in such a way that when attaching element 101 is attached to horizontal rail 301, the splash guard apparatus 100 is angled downward and is positioned below the openings in the seat of transfer bench 300. The transfer bench splash guard 100 can also attach to the top of the transfer bench 300 via attaching element 101. Straps, hooks or other attaching elements may also be utilized to attach transfer bench splash guard 100 to transfer bench 300. Alternatively, in an aspect, attachment side 109 does not comprise attaching element 101, and rather could lean on or contact an edge of the receptacle and be the side closest to transfer bench 300 as transfer bench splash guard 100 is positioned under the openings in the seat of transfer bench 300. Alternatively, attachment element 101, as the end structure of attaching side 109, could attach to the receptacle, instead of attaching to the transfer bench, and be positioned below the openings in the seat of transfer bench 300. Attachment element 101 could be shaped to connect to the receptacle, and may or may not have other attachment elements for attaching transfer bench splash guard 100 to a transfer bench, for example, for storage or transport of the transfer bench.

FIG. 5 shows transfer bench 300 with horizontal rail 301 placed in a receptacle 200, wherein transfer bench 300 is partially within receptacle 200, which in this instance is an indoors bath tub, and is partially outside of receptacle 200, leaving openings in the seat of transfer bench 300 open over the floor outside receptacle 200.

FIG. 6 shows transfer bench splash guard 100 attached to transfer bench 300 with horizontal rail 301 placed in a receptacle 200, wherein transfer bench 300 is partially within receptacle 200, which in this instance is an indoors bath tub, and is partially outside of receptacle 200. Transfer bench splash guard structure 101 is attached to transfer bench 300 with horizontal rail 301 by attachment element 101 partially surrounding a portion of horizontal rail 301. Seen underneath the seat of transfer bench 300 is the bottom surface 109 of transfer bench splash guard structure 101.

Figure 7:
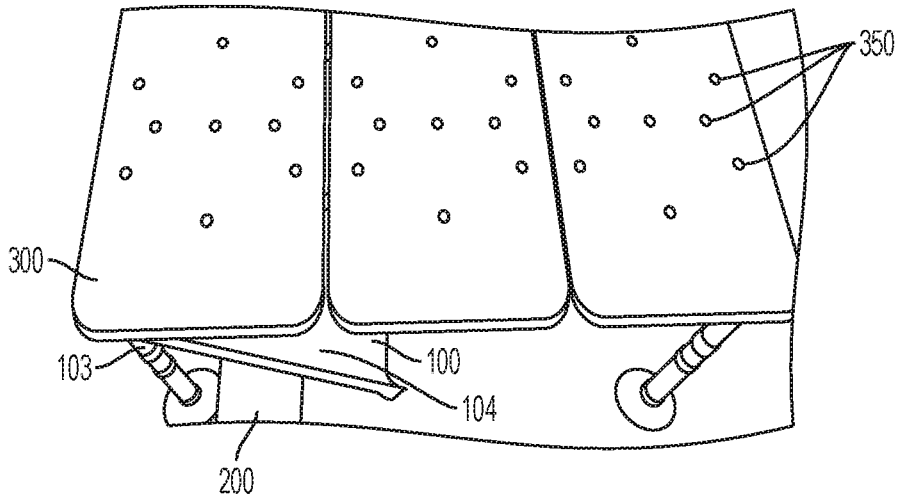

FIG. 7 is a picture of the seat or horizontal surface of a transfer bench 300 with an exemplary transfer bench splash guard 100 attached. The openings 350 in the seat allow for fluid flow through the openings to the transfer bench splash guard positioned below. The receptacle 200, bath tub, edge is shown and the transfer bench splash guard 100 is attached. In use, of the transfer bench splash guard 100 is attached to the transfer bench 300, which may be placed partially within receptacle 200, wherein fluid flows through one or more openings 350 in the horizontal surface of transfer bench 300 onto top surface 104 of transfer bench splash guard 100.

Figure 8:
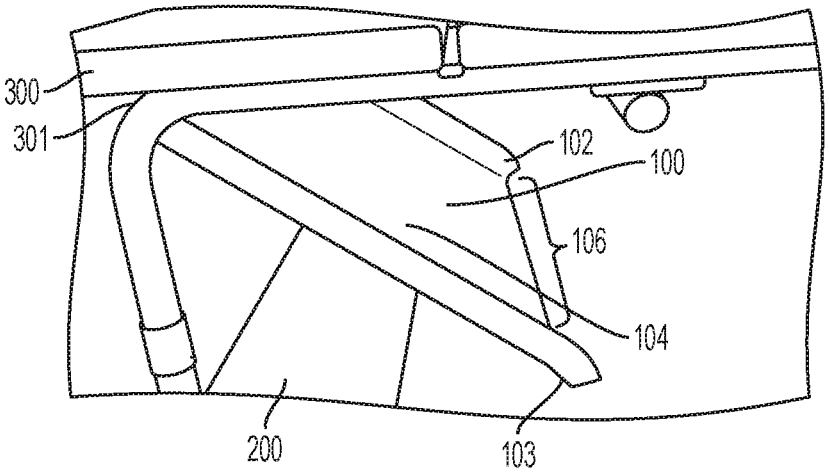
FIG. 8 is a picture of a side view of an exemplary transfer bench with an exemplary transfer bench splash guard attached thereto.

FIG. 8 is a picture of a side view of the seat or horizontal surface of a transfer bench 300 with an exemplary transfer bench splash guard attached. The receptacle 200, bath tub, edge is shown and the transfer bench splash guard 100 is positioned so that open end 106 is within the receptacle. Curved edges 102 and 103 aid in directing fluid flow into receptacle 200.

In use, transfer bench splash guard 100 is attached to transfer bench 300 which may be placed partially within receptacle 200, wherein transfer bench splash guard 100 contains and directs fluid flowing through openings in the seat of transfer bench 300 so fluid flows into receptacle 200 and also prevents fluid from flowing outside the receptacle 200. Transfer bench splash guard 100 is positioned under the transfer bench 300 at such an angle as to encourage fluid to flow back into the bathing enclosure 200. It may be a vertical angle, or angled in any other way. A goal of using transfer bench splash guard 100 is to minimize the mess of fluid escape that occurs when using a transfer bench 300 in a receptacle 200. Currently, fluid escapes through the holes or spaces in the seat of transfer bench 300. Use of transfer bench splash guard 100 should minimize this clean-up.

A method of using transfer bench splash guard 100 comprises a) attaching transfer bench splash guard 100 to transfer bench 300 so that at least a portion of transfer bench splash guard 100 is below one or more openings in a horizontal surface of transfer bench 300 and open end 106 is positioned to direct any fluid into receptacle 200; b) either before or after step a), contacting a subject positioned on the horizontal surface of transfer bench 300 with one or more fluids; wherein at least a portion of the fluid flows through one or more openings in the horizontal surface of transfer bench 300 onto top surface 104 of transfer bench splash guard 100 and is contained and directed into receptacle 200.

A method of using transfer bench splash guard 100 comprises 1) positioning at least a portion of transfer bench splash guard 100 below one or more openings in a horizontal surface of transfer bench 300, and open end 106 is positioned to direct any fluid into receptacle 200; b) either before or after step a), contacting a subject positioned on the horizontal surface of transfer bench 300 with one or more fluids; wherein at least a portion of the fluid flows through one or more openings in the horizontal surface of transfer bench 300 onto top surface 104 of transfer bench splash guard 100 and is contained and directed into receptacle 200.

A kit disclosed herein comprises at least one transfer bench splash guard disclosed herein. A kit may further include directions for use of one transfer bench splash guard disclosed herein.

Embodiments of the invention are described, with reference to the figures. Throughout the figures, like reference numbers indicate the same or similar components. References to preferred embodiments are for illustration and understanding, and should not be taken as limiting.

It must be noted that as used herein and in the appended claims, the singular forms "a", "an", and "the" include plural reference unless the context clearly dictates otherwise.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Unless defined otherwise, all technical and scientific terms used herein have the same meanings as commonly understood by one of skill in the art to which the disclosed method and compositions belong. Although any methods and materials similar or equivalent to those described herein can be used in the practice or testing of the present method and compositions, the particularly useful methods, devices, and materials are as described. Publications cited herein and the material for which they are cited are hereby specifically incorporated by reference. Nothing herein is to be construed as an admission that the present invention is not entitled to antedate such disclosure by virtue of prior invention. No admission is made that any reference constitutes prior art. The discussion of references states what their authors assert, and applicants reserve the right to challenge the accuracy and pertinency of the cited documents. It will be clearly understood that, although a number of publications are referred to herein, such reference does not constitute an admission that any of these documents forms part of the common general knowledge in the art.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

It is to be understood that the disclosed methods, devices and systems are not limited to specific methods or specific components, unless otherwise specified, and, as such, may vary. It is also to be understood that the terminology used herein is for the purpose of describing particular embodiments only and is not intended to be limiting.

Disclosed are materials, compositions, and components that can be used for, can be used in conjunction with, can be used in preparation for, or are products of the disclosed methods, devices and systems. These and other materials are disclosed herein, and it is understood that when combinations, subsets, etc. of these materials are disclosed that while specific reference of each various individual and collective combinations and permutation of these components may not be explicitly disclosed, each is specifically contemplated and described herein. Likewise, any subset or combination of these is also specifically contemplated and disclosed. Thus, for example, the sub-group of A-E, B-F, and C-E are specifically contemplated and should be considered disclosed from disclosure of A, B, and C; D, E, and F; and an example combination A-D. This concept applies to all aspects of this application including, but not limited to, steps in methods of making and using the disclosed devices. Thus, if there are a variety of additional steps that can be performed it is understood that each of these additional steps can be performed with any specific embodiment or combination of embodiments of the disclosed methods, and that each such combination is specifically contemplated and should be considered disclosed.

The embodiments were chosen and described in order to explain the principles of the claimed inventions and their practical application so as to enable others skilled in the art to utilize the inventions and various embodiments and with various modifications as are suited to the particular use contemplated. Alternative embodiments will become apparent to those skilled in the art to which the claimed inventions pertain without departing from their spirit and scope. Accordingly, the scope of the claimed inventions is defined by the appended claims rather than the foregoing description and the exemplary embodiments described therein.

What is claimed is:

1. A transfer bench splash guard, comprising:

a planar structure, comprising:

a top side;

a bottom side;

four edges, wherein optionally two of the four edges are angled upwardly from the topside;

wherein a third edge comprises an attachment element for attaching the splash guard apparatus, wherein the attachment element is configured so that the entire planar structure of the splash guard is angled downwardly when attached under a transfer bench; and the edge opposite the attachment element is open.

2. The transfer bench splash guard of claim 1, wherein the optionally angled two edges are of a size to prevent water from flowing over the sides of the planar structure.

3. The transfer bench splash guard of claim 1, wherein the top side further comprises a covering made from a water resistant material.

4. The transfer bench splash guard of claim 1, wherein the top side comprises a surface that collects hard matter from fluid.

5. The transfer bench splash guard of claim 1, wherein the top side is shaped to direct a flow of fluid.

6. The transfer bench splash guard of claim 1, wherein the top side is substantially flat.

7. The transfer bench splash guard of claim 1, wherein the planar member is curved downward.

8. The transfer bench splash guard of claim 1, wherein the planar structure is rectangular.

9. The transfer bench splash guard of claim 1, wherein the planar structure is angled in such a manner as to create a funnel for fluid to flow.

10. The transfer bench splash guard of claim 1, wherein the open side is connected to a receptacle.

11. The transfer bench splash guard of claim 1, wherein the bottom has a protective material or covering to prevent damage to an opposing surface.

12. The transfer bench splash guard of claim 1, wherein the bottom side has an adhesive material or covering to prevent movement of the member on an opposing surface.

13. The transfer bench splash guard of claim 1, wherein the bottom side is at least partially covered by a water-resistant material.

14. The transfer bench splash guard of claim 1, wherein the attachment element is selected from the group comprising: a snap-fit member and a clip.

15. A method of using transfer bench splash guard, comprising:

attaching to a transfer bench a transfer bench splash guard comprising, a top side; a bottom side; and four edges, wherein optionally two of the four edges are angled upwardly from the topside; wherein a third edge comprises an attachment element for attaching the splash guard apparatus, wherein the attachment element is configured so that the entire planar structure of the splash guard is angled downwardly when attached under a transfer bench; and the edge opposite the attachment element is open, so that the majority of the transfer bench splash guard is below a horizontal surface of the transfer bench.

* * * * *